US011014782B2

(12) United States Patent
Fargo et al.

(10) Patent No.: US 11,014,782 B2
(45) Date of Patent: May 25, 2021

(54) ELEVATOR SYSTEM RAILS

(71) Applicant: OTIS ELEVATOR COMPANY, Farmington, CT (US)

(72) Inventors: Richard N. Fargo, Plainville, CT (US); Walter Schmidt, Marlborough, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 492 days.

(21) Appl. No.: 15/545,130

(22) PCT Filed: Jan. 21, 2016

(86) PCT No.: PCT/US2016/014277

§ 371 (c)(1),
(2) Date: Jul. 20, 2017

(87) PCT Pub. No.: WO2016/118722

PCT Pub. Date: Jul. 28, 2016

(65) Prior Publication Data

US 2018/0009633 A1 Jan. 11, 2018

Related U.S. Application Data

(60) Provisional application No. 62/106,793, filed on Jan. 23, 2015.

(51) Int. Cl.
*B66B 7/02* (2006.01)
*B66B 9/00* (2006.01)
(Continued)

(52) U.S. Cl.
CPC ..... *B66B 7/023* (2013.01); *B66B 7/022* (2013.01); *B66B 7/026* (2013.01); *B66B 9/00* (2013.01);
(Continued)

(58) Field of Classification Search
CPC ... B66B 11/0407; B66B 7/026; B66B 19/002; B66B 2009/006; B66B 9/003
See application file for complete search history.

(56) References Cited

U.S. PATENT DOCUMENTS 3,814,027 A 6/1974 Vice
5,345,047 A * 9/1994 Ishii ..... B66B 11/0407 187/251
(Continued)

FOREIGN PATENT DOCUMENTS

CN 1198397 A 11/1998
CN 1511109 A 7/2004
(Continued)

OTHER PUBLICATIONS

Machine Translation of JPH 0570061.*
(Continued)

*Primary Examiner* — Diem M Tran
(74) *Attorney, Agent, or Firm* — Cantor Colburn LLP

(57) ABSTRACT

An elevator system includes one or more elevator cars configured to travel along a hoistway. One or more rails extend along the hoistway and are operably connected to the one or more elevator cars to guide the one or more elevator cars along the hoistway. Each rail of the one or more rails includes a plurality of rail segments arranged end to end. Each rail segment is affixed to a hoistway wall to transfer vertical loads from the rail segment to the hoistway wall. Each rail segment is secured to the hoistway wall via a plurality of rail support brackets. The vertical loads are transferred from the rail segment to the hoistway wall via at least one rail support bracket of the plurality of rail support brackets.

18 Claims, 7 Drawing Sheets

(51) Int. Cl.
*B66B 19/00* (2006.01)
*B66B 11/04* (2006.01)

(52) U.S. Cl.
CPC ..... *B66B 9/003* (2013.01); *B66B 11/0407* (2013.01); *B66B 19/002* (2013.01)

(56) References Cited

U.S. PATENT DOCUMENTS

| | | | | |
|---|---|---|---|---|
| 2007/0181374 | A1* | 8/2007 | Mueller | B66B 9/00 187/249 |
| 2013/0056310 | A1* | 3/2013 | Bjorni | B66B 7/022 187/359 |
| 2013/0270041 | A1* | 10/2013 | Loeser | B66B 11/0407 187/250 |

FOREIGN PATENT DOCUMENTS

| | | | | |
|---|---|---|---|---|
| CN | 1895982 | A | | 1/2007 |
| CN | 1914111 | A | | 2/2007 |
| CN | 101875465 | A | | 11/2010 |
| CN | 202245622 | U | * | 5/2012 |
| CN | 102730515 | A | * | 10/2012 |
| CN | 203545388 | U | | 4/2014 |
| CN | 103803376 | A | * | 5/2014 |
| CN | 203806903 | U | | 9/2014 |
| EP | 2006234 | A2 | | 11/2007 |
| EP | 2749518 | A1 | | 7/2014 |
| JP | 0570061 | A | | 3/1993 |
| JP | 0986825 | A | | 3/1997 |
| JP | 1087224 | A | | 4/1998 |
| JP | 10203747 | A | | 8/1998 |
| JP | 2011195230 | A | | 10/2011 |
| KR | 100221774 | B1 | | 9/1999 |
| WO | 2012154178 | | | 11/2012 |

OTHER PUBLICATIONS

Machine Translation of CN 103803376.*
Chinese Office Action Issued in CN Application No. 201680006823.2, dated Jan. 16, 2019, 10 Pages.
International Search Report and Written Opinion; International Application No. PCT/US2016/014277; International Filing Date: Jan. 21, 2016; dated May 3, 2016; 10 pages.

* cited by examiner

ELEVATOR SYSTEM RAILS

CROSS-REFERENCE TO RELATED APPLICATIONS

This application is a National Stage application of PCT/US2016/014277 filed on Jan. 21, 2016, which claims the benefit of U.S. Provisional Application No. 62/106,793, filed Jan. 23, 2015, which are incorporated herein by reference in their entirety.

BACKGROUND

The subject matter disclosed herein relates generally to the field of elevators, and more particularly to a multicar, ropeless elevator system.

Ropeless elevator systems, also referred to as self-propelled elevator systems, are useful in certain applications (e.g., high rise buildings) where the mass of the ropes for a roped system is prohibitive and there is a desire for multiple elevator cars to travel in a single lane. There exist ropeless elevator systems in which a first lane is designated for upward traveling elevator cars and a second lane is designated for downward traveling elevator cars. A transfer station at each end of the hoistway is used to move cars horizontally between the first lane and second lane.

In traditional elevator systems, rails are secured in the hoistway through the use of sliding clips secured to the hoistway wall. The clips allow for upward/downward sliding movement of the rail relative to the wall. Thus, the cumulative weight of the rail stack is supported in the pit at the bottom of the hoistway. The sliding clips allow for building settling, without causing the rails to buckle. An issue with this concept is that the rise of the elevator system is limited by the cumulative rail weight, and if this concept was applied to motor primaries used in ropeless elevator systems, the cumulative weight would be excessive and the thermal expansion would require significant cyclic sliding movement, leading to buckling or fatigue of the rail.

BRIEF SUMMARY

In one embodiment, an elevator system includes one or more elevator cars configured to travel along a hoistway. One or more rails extend along the hoistway and are operably connected to the one or more elevator cars to guide the one or more elevator cars along the hoistway. Each rail of the one or more rails includes a plurality of rail segments arranged end to end. Each rail segment is affixed to a hoistway wall to transfer vertical loads from the rail segment to the hoistway wall. Each rail segment is secured to the hoistway wall via a plurality of rail support brackets. The vertical loads are transferred from the rail segment to the hoistway wall via at least one rail support bracket of the plurality of rail support brackets.

Alternatively or additionally, in this or other embodiments a plurality of primary drive portions extend along the hoistway and are operably connectable to the one or more elevator cars to drive the one or more elevator cars along the hoistway. Each primary segment of the plurality of primary portions is affixed to the hoistway wall via the plurality of rail support brackets to transfer vertical loads from the primary portion to the hoistway wall via at least one rail support bracket of the plurality of rail support brackets.

Alternatively or additionally, in this or other embodiments a gap exists between vertically adjacent primary portions.

Alternatively or additionally, in this or other embodiments the plurality of rail support brackets is three rail support brackets.

Alternatively or additionally, in this or other embodiments vertically adjacent rail segments of the plurality of rail segments are connected via a connecting plate allowing for expansion and/or contraction of a spacing between the adjacent rail segments.

Alternatively or additionally, in this or other embodiments the spacing is between about 1 millimeter and 4 millimeters.

Alternatively or additionally, in this or other embodiments vertically adjacent rail segments include an expansion joint therebetween to maintain a smooth running surface along the rail.

Alternatively or additionally, in this or other embodiments the expansion joint includes a tongue portion at a first rail segment and a groove portion at a second rail segment configured to receive the tongue portion.

Alternatively or additionally, in this or other embodiments the tongue portion and/or the groove portion slope along a rail height at an angle non-perpendicular to the running surface.

Alternatively or additionally, in this or other embodiments the angle is between about 15 degrees and 75 degrees, relative to the running surface.

Alternatively or additionally, in this or other embodiments the elevator system is a multi-car ropeless elevator system.

In another embodiment, a guide rail assembly for an elevator system includes a plurality of rail segments arranged end to end. A rail support bracket is affixed to each rail segment to transfer vertical loads from the rail segment to a hoistway wall.

Alternatively or additionally, in this or other embodiments vertically adjacent rail segments of the plurality of rail segments are connected via a connecting plate allowing for expansion and/or contraction of a spacing between the adjacent rail segments.

Alternatively or additionally, in this or other embodiments the spacing is between about 1 millimeter and 4 millimeters.

Alternatively or additionally, in this or other embodiments vertically adjacent rail segments include an expansion joint therebetween to maintain a smooth running surface along the rail.

Alternatively or additionally, in this or other embodiments the expansion joint includes a tongue portion at a first rail segment and a groove portion at a second rail segment configured to receive the tongue portion.

Alternatively or additionally, in this or other embodiments the tongue portion and/or the groove portion slope along a rail height at an angle non-perpendicular to the running surface.

Alternatively or additionally, in this or other embodiments the angle is between about 15 degrees and 75 degrees, relative to the running surface.

The detailed description explains the invention, together with advantages and features, by way of examples with reference to the drawings.

DETAILED DESCRIPTION

Figure 1:
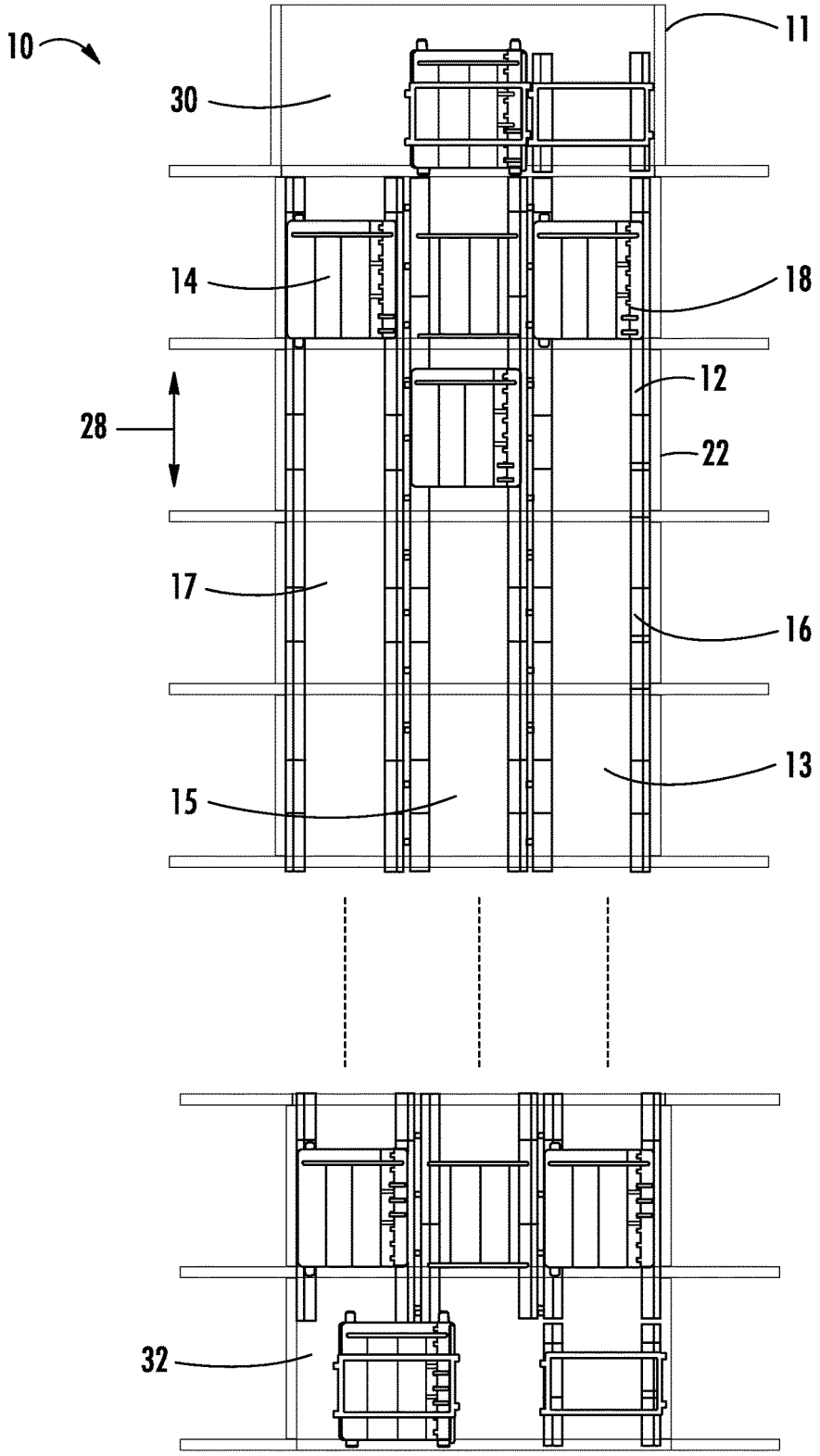
FIG. 1 depicts a multicar elevator system in an exemplary embodiment.

FIG. 1 depicts a multicar, ropeless elevator system 10 in an exemplary embodiment. Elevator system 10 includes a hoistway 11 having a plurality of lanes 13, 15 and 17. While three lanes are shown in FIG. 1, it is understood that embodiments may be used with multicar, ropeless elevator systems have any number of lanes. In each lane 13, 15, 17, cars 14 travel in one direction, i.e., up or down. For example, in FIG. 1 cars 14 in lanes 13 and 15 travel up and cars 14 in lane 17 travel down. One or more cars 14 may travel in a single lane 13, 15, and 17.

Above the top floor is an upper transfer station 30 to impart horizontal motion to elevator cars 14 to move elevator cars 14 between lanes 13, 15 and 17. It is understood that upper transfer station 30 may be located at the top floor, rather than above the top floor. Below the first floor is a lower transfer station 32 to impart horizontal motion to elevator cars 14 to move elevator cars 14 between lanes 13, 15 and 17. It is understood that lower transfer station 32 may be located at the first floor, rather than below the first floor. Although not shown in FIG. 1, one or more intermediate transfer stations may be used between the first floor and the top floor. Intermediate transfer stations are similar to the upper transfer station 30 and lower transfer station 32.

Cars 14 are propelled using a linear motor system having a primary, fixed portion 16 and a secondary, moving portion 18. The primary portion 16 includes windings or coils mounted at one or both sides of the lanes 13, 15 and 17. Secondary portion 18 includes permanent magnets mounted to one or both sides of cars 14. Primary portion 16 is supplied with drive signals to control movement of cars 14 in their respective lanes along rails 12 extending along the hoistway 11.

Figure 2:
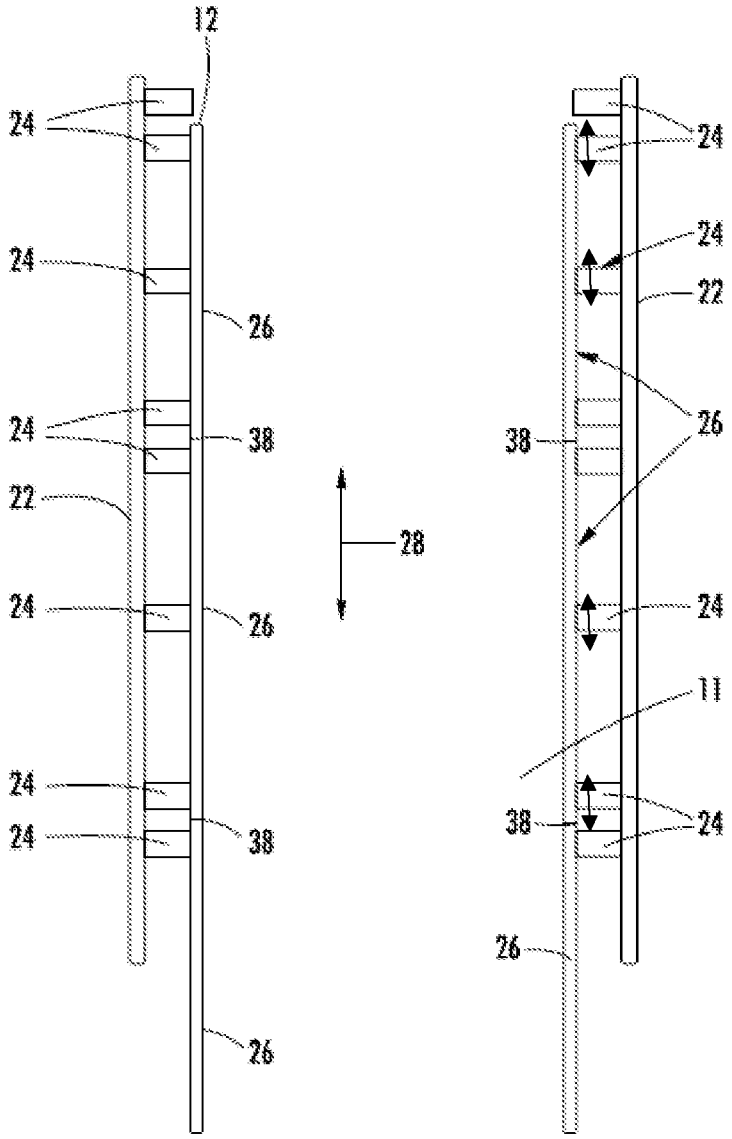
FIG. 2 depicts an embodiment of a guide rail assembly for an elevator system.

Referring now to FIG. 2, the rails 12 are installed as rail segments 26 arranged end-to-end and directly supported by hoistway walls 22. A number of rail brackets 24 are rigidly secured to the hoistway wall 22, via bolts, screws, welding or other attachment means. In some embodiments, each rail segment 26 is connected to three rail brackets 24, but it is to be appreciated that other quantities of rail brackets 24 may be utilized to support each rail segment 26, for example, 4, 5 or 6 rail brackets 24, depending on the length of the rail segments 26. Each rail segment 26 is rigidly secured to one or more rail brackets 24, and is slidingly secured to the remaining rail brackets 24. By being rigidly secured to at least one of the rail brackets 24, vertical loads are transferred from the rail segment 26 to the hoistway wall 22, and the sliding connection to the remaining rail brackets 24 allows for building settling and thermal expansion, without causing buckling of the rail segment 26. In some embodiments, the rail segments 26 are between about 8 feet and about 12 feet in length. While embodiments of the invention are described herein with respect to rails 12 and rail segments 26, it is to be appreciated that primary portions 16 may be similarly secured to and vertically supported by the hoistway walls 22 via the same rail brackets 24 or separate primary brackets (not shown).

Figure 3:
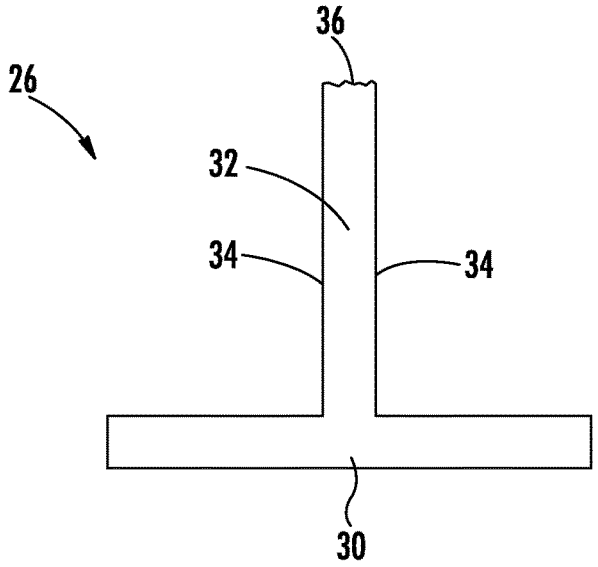
FIG. 3 depicts a cross-sectional view of an embodiment of a guide rail.

With this attachment scheme, rail segments 26 and primary portions 16 are able to move vertically, along a longitudinal direction 28 of the rail segment 26 relative to adjacent rail segments 26 and primary portions 16, due to thermal expansion and other forces. To mitigate such forces, the primary portions 16 are arranged with a small gap, in some embodiments about 2 millimeters, between vertically adjacent primary portions 16. Maintaining this gap between the adjacent primary portions 16 allows the adjacent primary portions 16 to remain aligned, while avoiding cumulative loads of the weight of hundreds of meters of primaries portions 16. The rails segments 26 and primary portions 16 can share the same rail brackets 24, since the load is not cumulative between them. The total load transmitted to the building at a rail bracket 24 location is equal the weight of the locally supported rail segment 26 and primary portion 16, plus the weight of the elevator car 14 when the elevator car 14 is present. In a typical elevator, the elevator moves vertically along the rail segments 26. As shown in FIG. 3, the rail segment 26 cross-section includes a base 30 providing an interface to the rail brackets 24. A blade 32 extends into the hoistway 11 from the base 30, and includes side surfaces 34 and a tip surface 36. To support the elevator car 14 in the hoistway 11, rollers (not shown) or other components of the elevator car 14 ride on the side surfaces 34 and tip surface 36, which thus define "running surfaces". Referring again to FIG. 2, to provide a smooth running surface for the elevator cars 14, the rail segments 26 are arranged with a joint 38, also referred to as an expansion joint. The joint 38 between adjacent rail segments 26 is slanted or otherwise overlapping, so that a roller will simultaneously contact both adjacent rail segments 26 as it passes over the joint 38. Exemplary embodiments of joints 38 are described below with reference to FIGS. 4-6.

Figure 4:
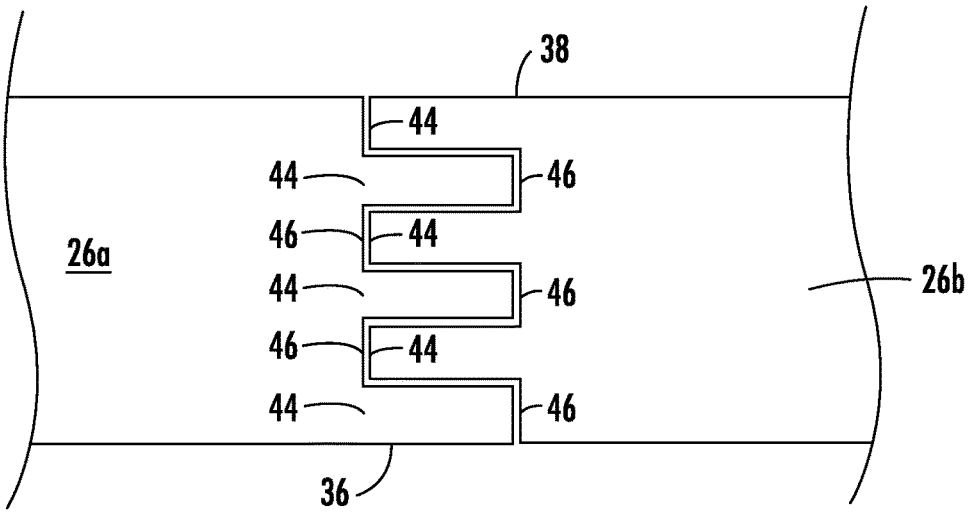
FIG. 4 depicts an embodiment of a joint for a guide rail assembly of an elevator system.

Referring to FIG. 4, in one exemplary embodiment, the joint 38 comprises a plurality of interlocking fingers. Each rail segment 26 has a first end 40 and a second end 42. Each segment end 40, 42 includes a plurality of rail fingers 44 separated by a plurality of rail pockets 46. The rail segments 26 are arranged such that the rail fingers 44 of a first rail segment 26*a* are located in rail pockets 46 of a second rail segment 26*b*, while the rail fingers 44 of the second rail segment 26*b* are positioned at the rail pockets 46 of the first rail segment 26*a*, thus forming the joint 38. When the rail segments 26 expand, contract, or otherwise shift position, the joint 38 continues to provide a smooth riding surface.

Figure 5:
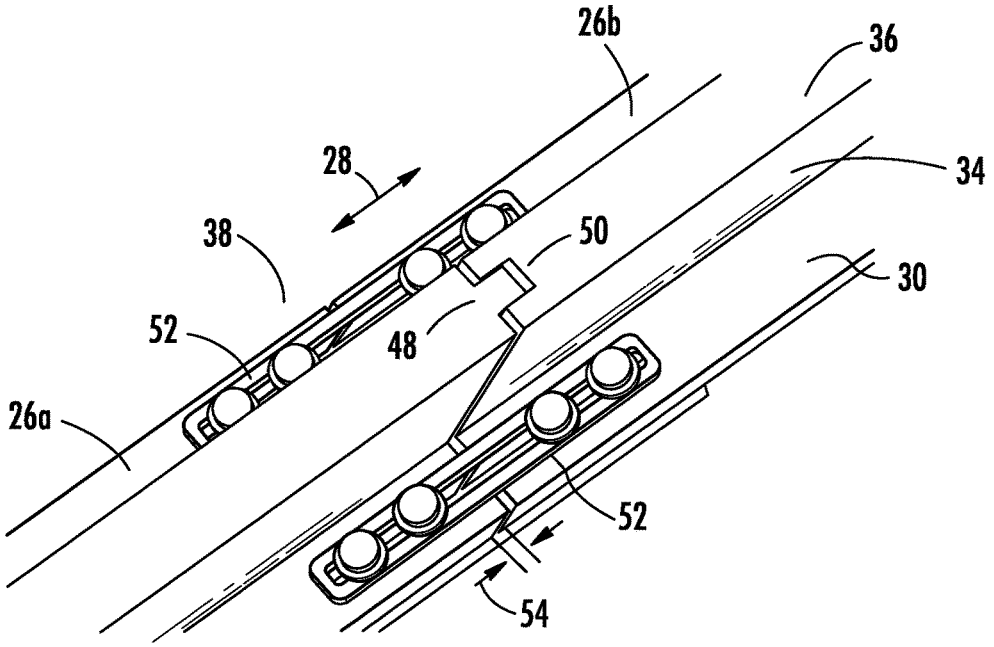
FIG. 5 depicts another embodiment of a joint for a guide rail assembly of an elevator system.

Referring now to FIG. 5, in another exemplary embodiment, the joint 38 is a tongue and groove joint. A tongue 48 at the first rail segment 26*a* is inserted into a groove 50 of the second rail segment 26*b*. Further, a connecting plate 52 spans from the first rail segment 26*a* to the second rail segment 26*b* and is secured to the rail segments 26*a*, 26*b*. The connecting plate 52 aids in maintaining alignment of the rail segments 26*a*, 26*b* while allowing an expansion and/or contraction of a spacing 54 between the first rail segment 26*a* and the second rail segment 26*b*, through, for example a sliding or slotted connection between the connecting plate 52 and one or more of the rail segments 26*a*, 26*b*. In some embodiments, the spacing 54 is between about 1 millimeter and 4 millimeters at installation of the rail segments 26*s*, 26*b*.

Figure 5A:
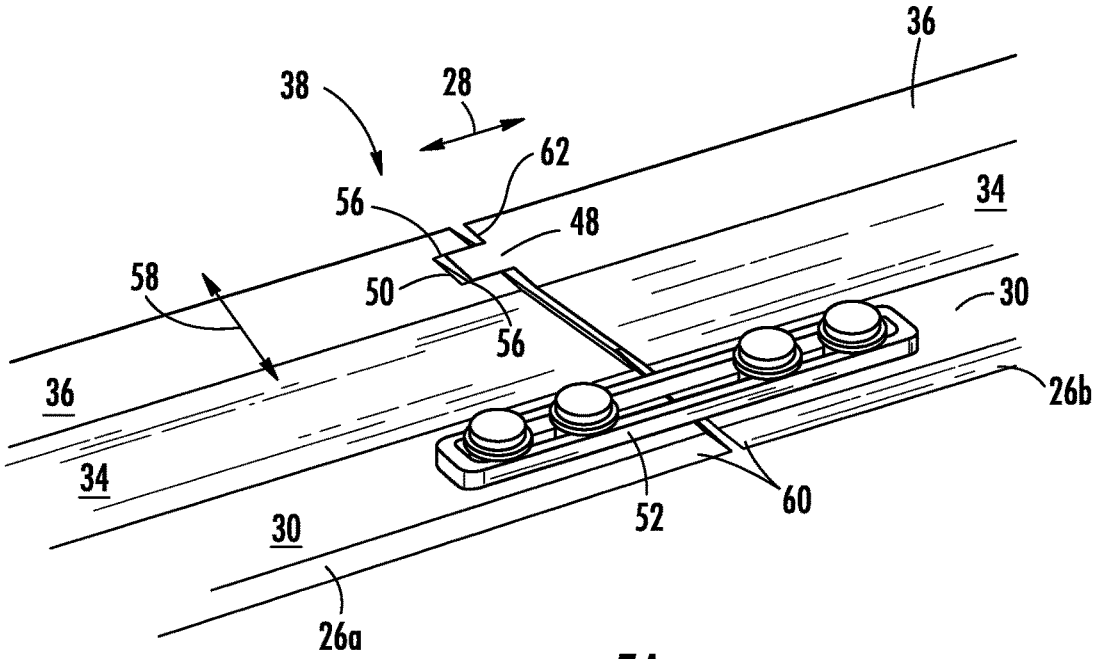
FIG. 5*a* depicts an exemplary embodiment of a tongue and groove rail configuration.

Additional embodiments of tongue and groove joints 38 are illustrated in FIGS. 5*a*-5*e*. In the embodiment of FIG. 5*a*, looking from the center of the hoistway 11 toward the rail 12, the tongue and groove joint 38 includes a vertically oriented groove 50 or slot in the first rail segment 26*a*, and a mating protrusion or tongue 48 in the adjacent rail segment 26*b*. A portion of the sides 56 of both the tongue 48 and groove 50 are parallel, and closely fitting to maintain alignment of adjacent rail segments 26 in a front to back direction 58. The ends 60 of the adjacent rail segments 26 at both a shoulder 62 and tongue 48 and groove 50 are spaced apart by about 2 mm, to allow for building settling or differential thermal expansion between the rails 12 and building. There is enough overlap between the tongue 48 and groove 50 to assure that a side to side guide roller will always be supported by at least one of the adjacent rails along the tip surface 36.

Looking at the rail 12 from the front or back of the hoistway 11 will show an angled joint, with a gap of about 2 mm. The angle, in some embodiments between about 15 degrees and 75 degrees is of sufficient slope to assure that a roller with a width of about 10 mm, travelling in a vertical direction will always be supported by at least one of the adjacent rail segments 26 along the side surfaces 34.

Figure 5B:
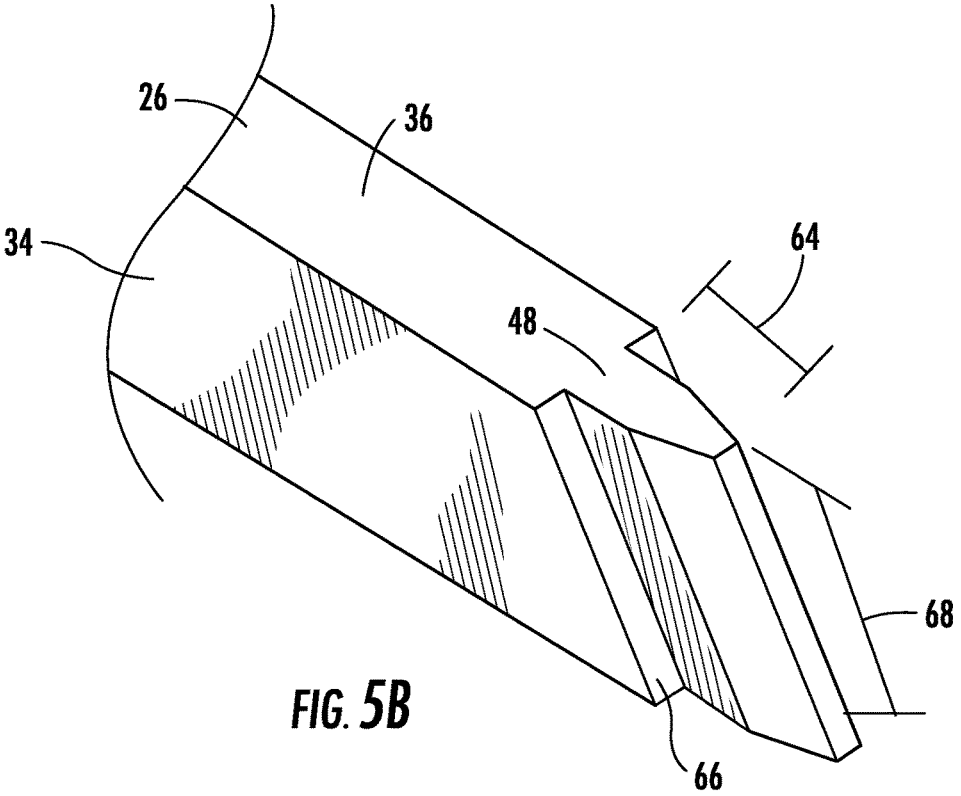
FIG. 5*b* depicts another exemplary embodiment of a tongue and groove rail configuration.
Figure 5C:
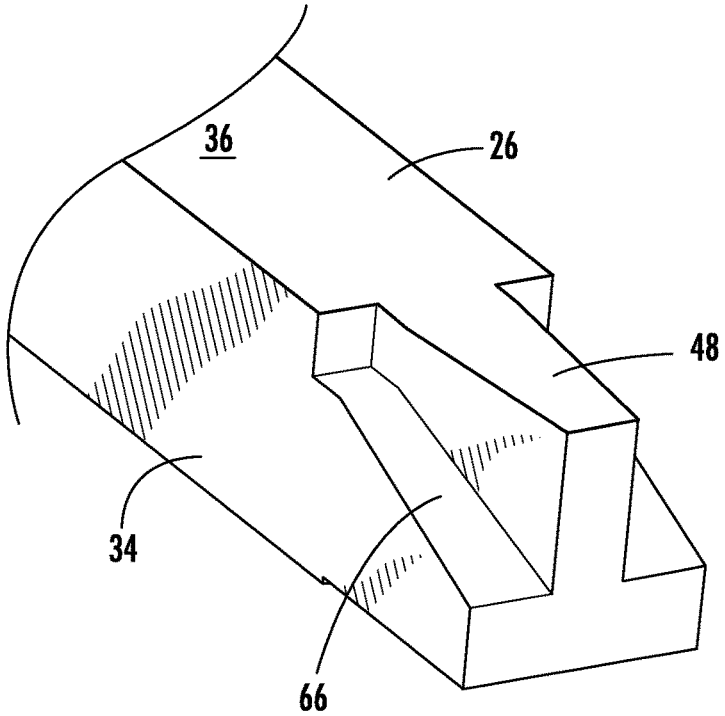
FIG. 5*c* depicts yet another exemplary embodiment of a tongue and groove rail configuration.
Figure 5D:
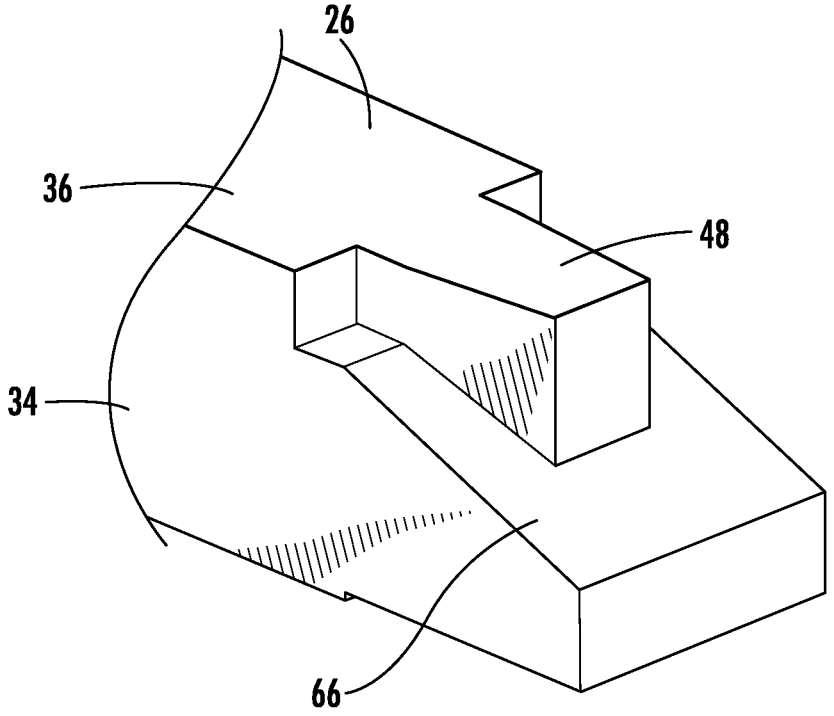
FIG. 5*d* depicts still another exemplary embodiment of a tongue and groove rail configuration.
Figure 5E:
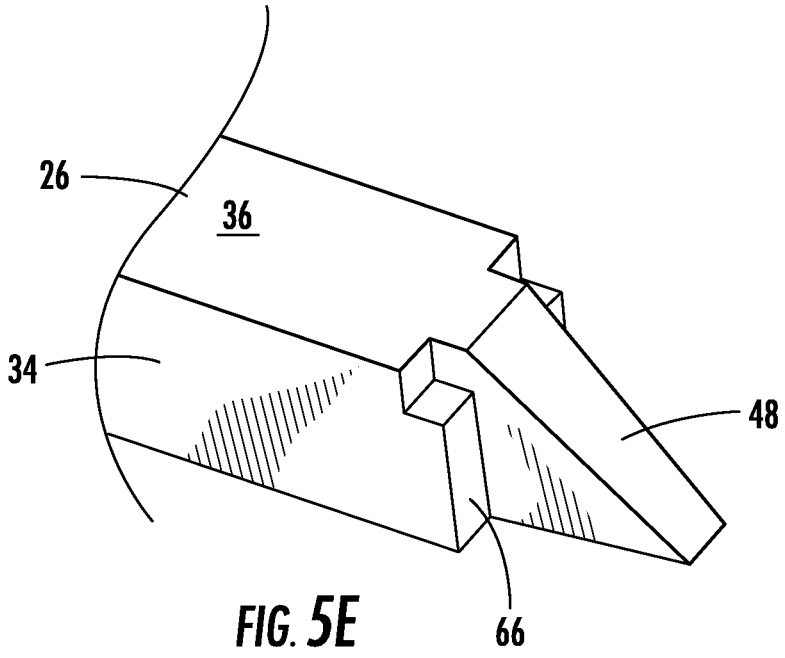
FIG. 5*e* depicts another exemplary embodiment of a tongue and groove rail configuration.

In the embodiment of FIG. 5*b*, the tongue 48 tapers or narrows along a tongue length 64. In the embodiments of FIGS. 5*c*-5*d*, side portions 66 slope along the rail height 68, but the slope terminates partway along the rail height 68, while in the embodiment of FIG. 5*e*, the side portions 66 do not slope along the rail height 68.

Figure 6:
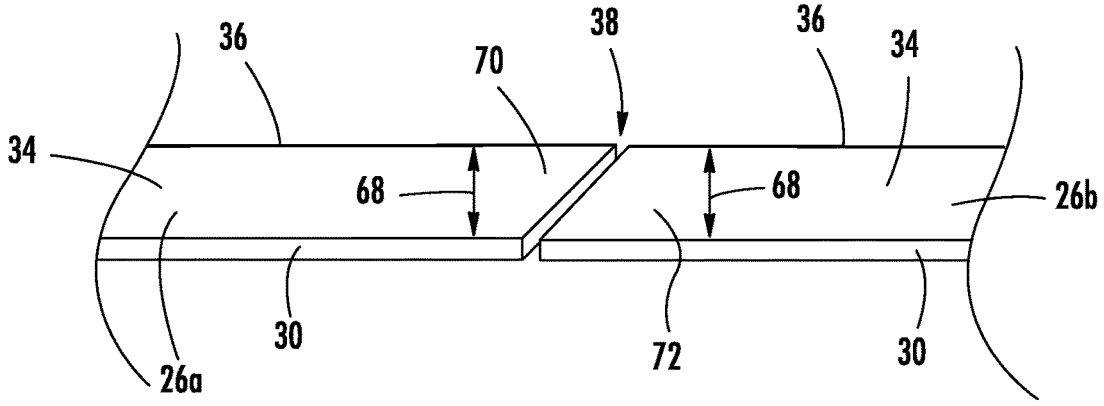
FIG. 6 depicts yet another embodiment of a joint for a guide rail assembly of an elevator system.

Referring to FIG. 6, in another embodiment, the joint 38 is a lap joint. In this embodiment, the first rail segment 26*a* has a rail height 68 having a first tapered portion 70 that is tapered upwardly toward the tip surface 36 of the rail segment 26*a*. The second rail segment 26*b*, abutting the first rail segment 26*a* has a complimentary second tapered portion 72, with the rail height 68 tapered downwardly away from the tip surface 36 and toward the rail base 30. When the rail segments 26*a*, 26*b* are positioned, the first tapered portion 70 overlaps with the second tapered portion 72, providing the smooth running surface along the tip surface 36 and the side surfaces 34 that still allows for thermal expansion and relative movement of the rail segments 26*a*, 26*b*.

The disclosed attachment scheme avoids vertically supporting the rail segments 26 at the pit at the bottom of the hoistway 11, and the load is vertically supported by the hoistway walls 22, thus reducing cumulative loads on the rail segments and the potential for fatigue or buckling of the rail segments 26. This allows for reduction in size and strength requirements for the rails, thus allowing their weight to be reduced, making handling and installation or the rail segments 26 easier. The joints 38 will maintain a smooth running surface resulting in favorable ride quality even with building settling or sway.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An elevator system comprising:

one or more elevator cars configured to travel along a hoistway; and one or more rails extending along the hoistway and operably connected to the one or more elevator cars to guide the one or more elevator cars along the hoistway, each rail of the one or more rails including a plurality of rail segments arranged end to end, each rail segment affixed to a hoistway wall via a plurality of rail support brackets;

wherein the vertical loads are transferred from the plurality of rail segments to the hoistway wall via at least one rail support bracket of the plurality of rail support brackets;

wherein a rail segment of the plurality of rail segments is rigidly affixed to a first rail support bracket of the plurality of rail support brackets to transfer the vertical loads from the rail segment to the hoistway wall, and at least a second rail support bracket of the plurality of rail support brackets spaced apart from the first rail support bracket along the rail segment is vertically slidingly connected to the rail segment.

2. The elevator system on claim 1, further comprising a plurality of primary drive portions extending along the hoistway and operably connectable to the one or more elevator cars to drive the one or more elevator cars along the hoistway, each primary segment of the plurality of primary portions affixed to the hoistway wall via the plurality of rail support brackets to transfer vertical loads from the primary portion to the hoistway wall via at least one rail support bracket of the plurality of rail support brackets.

3. The elevator system of claim 2, further comprising a gap between vertically adjacent primary portions.

4. The elevator system of claim 1, wherein the plurality of rail support brackets is three rail support brackets.

5. The elevator system of claim 1, wherein vertically adjacent rail segments of the plurality of rail segments are connected via a connecting plate allowing for expansion and/or contraction of a spacing between the adjacent rail segments, the connecting plate including a slot extding across the spacing between the adjacent rail segments, through which the vertically adjacent rail segments are connected.

6. The elevator system of claim 5, wherein the spacing is between about 1 millimeter and 4 millimeters.

7. The elevator system of claim 1, wherein vertically adjacent rail segments include an expansion joint therebetween to maintain a smooth running surface along the rail.

8. The elevator system of claim 7, wherein the expansion joint includes a tongue portion at a first rail segment and a groove portion at a second rail segment configured to receive the tongue portion.

9. The elevator system of claim 8, wherein the tongue portion and/or the groove portion slope along a rail height at an angle non-perpendicular to the running surface.

10. The elevator system of claim 9, wherein the angle is between about 15 degrees and 75 degrees, relative to the running surface.

11. A guide rail assembly for an elevator system comprising:

a plurality of rail segments arranged end to end; and a plurality of rail support brackets affixed to each rail segment of the plurality of rail segments to transfer vertical loads from the rail segment to a hoistway wall;

wherein a rail segment of the plurality of rail segments is rigidly affixed to a first rail support bracket of the plurality of rail support brackets to transfer the vertical loads from the rail segment to the hoistway wall, and at least a second rail support bracket of the plurality of rail support brackets spaced apart from the first rail support bracket along the rail segment vertically slidingly connected to the rail segment.

12. The guide rail assembly of claim 11, wherein the plurality of rail support brackets is three rail support brackets.

13. The guide rail assembly of claim 11, wherein vertically adjacent rail segments of the plurality of rail segments are connected via a connecting plate allowing for expansion and/or contraction of a spacing between the adjacent rail segments, the connecting plate including a slot extding across the spacing between the adjacent rail segments, through which the vertically adjacent rail segments are connected.

14. The guide rail assembly of claim 13, wherein the spacing is between about 1 millimeter and 4 millimeters.

15. The guide rail assembly of claim 11, wherein vertically adjacent rail segments include an expansion joint therebetween to maintain a smooth running surface along the rail.

16. The guide rail assembly of claim 15, wherein the expansion joint includes a tongue portion at a first rail segment and a groove portion at a second rail segment configured to receive the tongue portion.

17. The guide rail assembly of claim 16, wherein the tongue portion and/or the groove portion slope along a rail height at an angle non-perpendicular to the running surface.

18. The guide rail assembly of claim 17, wherein the angle is between about 15 degrees and 75 degrees, relative to the running surface.

* * * * *